US007258602B2

(12) United States Patent
Shih et al.

(10) Patent No.: US 7,258,602 B2
(45) Date of Patent: Aug. 21, 2007

(54) POLISHING PAD HAVING GROOVED WINDOW THEREIN AND METHOD OF FORMING THE SAME

(75) Inventors: Wen-Chang Shih, Taichung (TW); Yung-Chung Chang, Taipei (TW); Min-Kuei Chu, Taichung (TW)

(73) Assignee: IV Technologies Co., Ltd., Taichung (TW)

( * ) Notice: Subject to any disclaimer, the term of this patent is extended or adjusted under 35 U.S.C. 154(b) by 265 days.

(21) Appl. No.: 10/949,048

(22) Filed: Sep. 24, 2004

(65) Prior Publication Data

US 2005/0090187 A1 Apr. 28, 2005

Related U.S. Application Data

(60) Provisional application No. 60/514,092, filed on Oct. 22, 2003.

(51) Int. Cl.
*B24D 11/00* (2006.01)
*B24B 49/00* (2006.01)

(52) U.S. Cl. ..... 451/527; 451/6

(58) Field of Classification Search ..... 451/41, 451/56, 526–534, 285–289, 6
See application file for complete search history.

(56) References Cited

U.S. PATENT DOCUMENTS 5,433,651 A 7/1995 Lustig et al.
5,893,796 A 4/1999 Birang et al.
6,093,651 A * 7/2000 Andideh et al. ..... 451/41
6,171,181 B1 1/2001 Roberts et al.
6,340,325 B1 * 1/2002 Chen et al. ..... 451/56
6,458,014 B1 * 10/2002 Ihsikawa et al. ..... 451/41
6,641,470 B1 11/2003 Zhao et al.
6,688,945 B2 2/2004 Liu
6,752,690 B1 6/2004 Fruitman
6,832,949 B2 12/2004 Konno et al.
6,855,034 B2 2/2005 Hasegawa
7,118,457 B2 * 10/2006 Swedek et al. ..... 451/41
2003/0171081 A1 9/2003 Komukai
2003/0236055 A1 12/2003 Swedek et al.
2005/0060943 A1 * 3/2005 Turner et al. ..... 451/534

FOREIGN PATENT DOCUMENTS

CN 1681622 A 10/2005
WO WO 01-98028 12/2001

* cited by examiner

*Primary Examiner*—Hadi Shakeri
(74) *Attorney, Agent, or Firm*—Ditthavong Mori & Steiner, P.C.

(57) ABSTRACT

A polishing pad having grooved window therein is provided. The polishing pad comprises a polishing layer and a window, wherein the polishing layer has at least one first groove therein and the window has at least one second groove therein. More particularly, the first groove is deeper than the second groove. The polishing pad having a grooved window therein has advantages of providing precise endpoint detection and thereby reducing or resolving defect problems.

12 Claims, 4 Drawing Sheets

100

100

POLISHING PAD HAVING GROOVED WINDOW THEREIN AND METHOD OF FORMING THE SAME

CROSS-REFERENCE TO RELATED APPLICATION

This application claims the priority benefits of U.S. provisional application titled "Grooved Window Pad And Method Of Forming The Same" filed on Oct. 22, 2003, Ser. No. 60/514,092. All disclosure of this application is incorporated herein by reference.

BACKGROUND OF THE INVENTION

1. Field of the Invention

The present invention generally relates to a polishing pad and a method of forming the same. More particularly, the present invention relates to a polishing pad having grooved window therein and a method of forming the same.

2. Description of Related Art

Endpoint detection techniques have been generally used for chemical-mechanical polishing (CMP) to ensure the polishing quality. Among those techniques, optical endpoint detection through a transparent detection window in a polishing pad provides a reliable result.

U.S. Pat. No. 5,893,796 discloses a method of forming a transparent window in a polishing pad by forming an aperture in a polishing layer first, and then a transparent window is fixed in the aperture with a layer of adhesive. Unfortunately, the slurry solution inevitably permeates through transparent window/polishing layer interface and leaks into the backside of the polishing pad, especially under the influence of the stress during polishing. Meanwhile, this would interfere with the optical signal and therefore the endpoint detection cannot be accurate.

U.S. Pat. No. 6,171,181 discloses a polishing pad with an integral window without above-mentioned slurry solution leakage problem. However, thereafter, during the process of forming grooves on the polishing pad with an integral window, grooves are also formed on the window portion with same groove depth as the grooves formed in the non-window portion. The non-smooth surface of the window portion, with grooves thereon, will lead to less light permeability and get lower reflected optical signal, which will degrade sensitivity of the endpoint detection. Besides, byproducts produced by reaction between polished materials and slurry and the slurry abrasive accumulated in the grooves on the window portion further makes endpoint detection difficult, even when the lifetime of the polishing pad is still within specification.

It is possible to form grooves by using mechanical techniques, such as cutting, only on the non-window portion of the polishing pad by controlling the distance between cutting tool and polishing pad, that is, the cutting tool lifts up only for the widow portion. However, the distance controlling stability for aligning to the window portion is challenging. Furthermore, there are some drawbacks of the polishing pad with no grooves formed on the window portion, firstly, sharp rising step of groove depth from grooved non-window portion to non-grooved widow portion will become a defect source when substrate moves relatively across window portion. Secondly, uneven friction and poor wettability of the window portion relative to non-window portion, due to absence of grooves on the entire window surface, makes the window itself become another defect source.

It would be desirable if a polishing pad having a transparent window therein that normally functions for endpoint detection can be utilized, while at the same time, the defects described above can be reduced or resolved.

SUMMARY OF THE INVENTION

Accordingly, the present invention is directed to a polishing pad having a grooved window therein and a method of forming the same, capable of providing good slurry transportation and normal endpoint detection.

According to an embodiment of the present invention, a polishing pad having a grooved window therein is provided. The polishing pad comprises a polishing layer and a window therein. The polishing layer has at least one first groove therein and the window has at least one second groove therein. More particularly, the first groove is deeper than the second groove.

According to another embodiment of the present invention, a method of forming a polishing pad having grooved window therein is provided. A window is formed in a polishing layer. Thereafter, at least one first groove is formed in the polishing layer and at least one second groove is formed in the window, wherein the first groove is deeper than the second groove.

According to an embodiment of the present invention, the second groove is formed in the window so as to improve the flow of slurry at the window portion. In addition, since the second groove formed in the window is shallower than the first groove formed in the polishing layer, the endpoint detection is precise.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
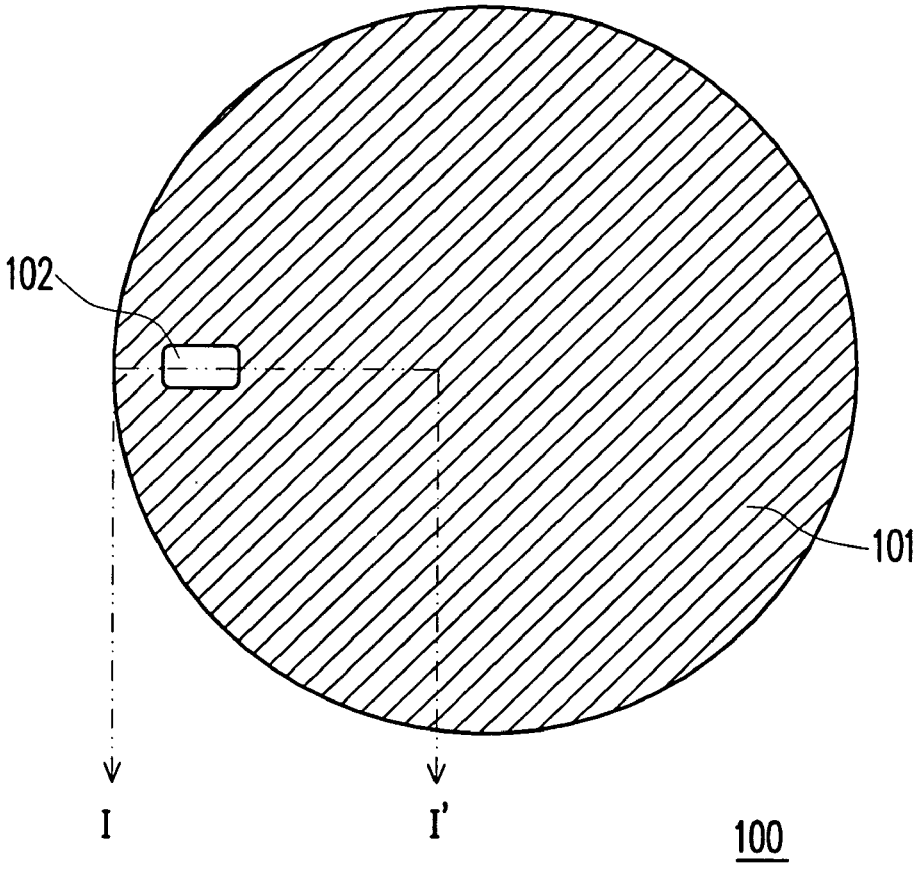
FIG. 1 is a schematic top view showing a polishing pad having a transparent window therein according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
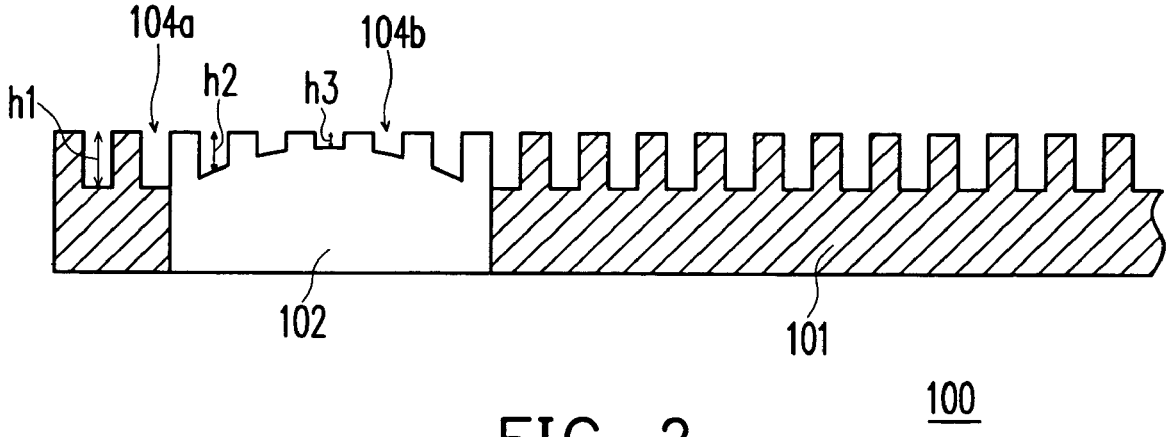
FIG. 2 is a schematic cross-sectional view along I-I' of FIG. 1 showing the structure of the polishing pad.

FIG. 1 is a schematic top view showing a polishing pad with a transparent window according to an embodiment of the present invention. FIG. 2 is a schematic cross-sectional view along I-I' of FIG. 1 showing the structure of the polishing pad.

As shown in FIG. 1 and FIG. 2, a polishing pad 100 comprising a polishing layer 101 and a window 102 therein is provided. More particularly, at least one first groove 104*a* and at least one second groove 104*b* are formed in the polishing layer 101 and the window 102 respectively for improving the flow of slurry, wherein the first groove 104*a* is formed deeper than the second groove 104*b*. In other words, the depth (h2, h3) of the second groove 104*b* formed in the window 102 is shallower relative to the depth (h1) of the first groove 104*a* in the polishing layer 101. In an embodiment of the present invention, the second groove 104*b* in the window 102 has different depths. Preferably, the profile of the depth of the second groove 104*b* is such that the depth gradually reduces from an edge area of the window 102 towards the central area of the window 102. For example, the second groove 104*b* has a larger depth h2 at the edge area of the window 102 compared to depth h3 at the central area of the window 102.

In an embodiment of the present invention, the polishing layer 101 is constituted of a polymer material. For example, the polymer material is selected from a group consisting of polyurethane (PU), epoxy resin, phenol formaldehyde (PF) resin, melamine resin, thermosetting resin and a combination thereof. The window 102 is a transparent window and is constituted of a transparent polymer, for example.

Accordingly, the polishing pad 100 of the present invention comprises a polishing layer 101 having the first groove 104*a* therein and a window 102 having the second groove 104*b* therein, wherein the first groove 104*a* is deeper than the second groove 104*b*. More particularly, the depth of the second groove 104*b* at the edge area of the window 102 is substantially deeper compared to that at the central area of the window 102 so that the slurry does not be retained in the second groove, and the endpoint detection is precise.

The method of forming the polishing pad 100 comprises, first, a window 102 formed in a polishing layer 101. Thereafter, at least one first groove 104*a* is formed in the polishing layer 101 and at least one second groove 104*b* is formed in the window 102, wherein the first groove 104*a* is deeper than the second groove 104*a*. In an embodiment of the present invention, the polishing layer 101 and the window 102 are formed with a molding process. For example, the window 102 is first disposed in a mold, and a polymer is injected into the mold to form the polishing layer 101. After releasing the mold, a polishing pad 100 including the polishing layer 101 and the window 102 can be obtained. Alternatively, the polishing pad 100 including the polishing layer 101 and the window 102 can be formed using other suitable known methods.

Figure 3:
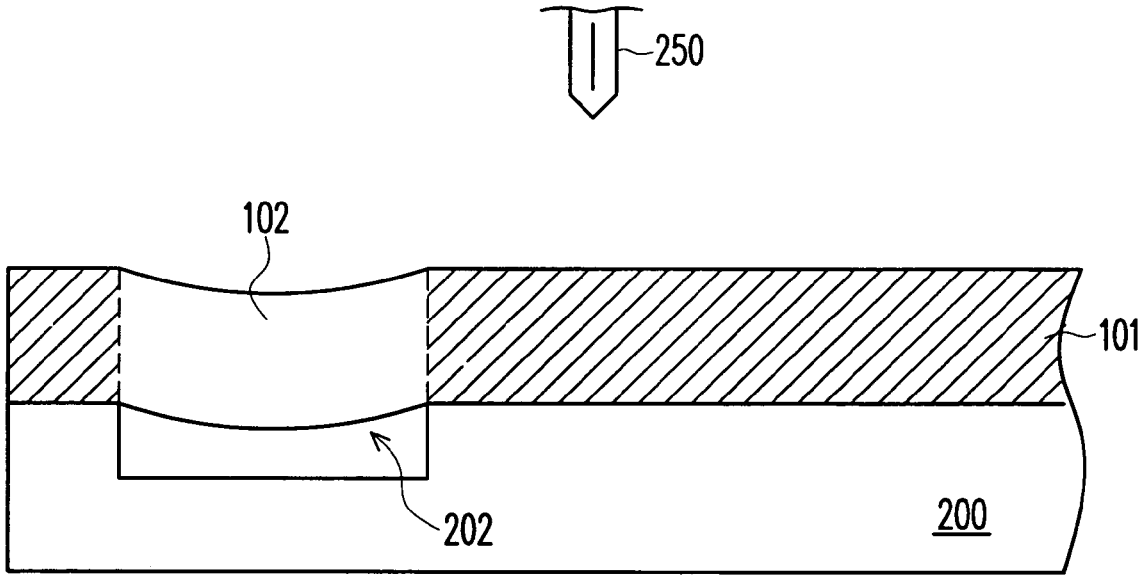
FIG. 3 is a schematic cross-sectional view showing a method of forming first groove and second groove in a polishing pad according to an embodiment of the present invention.

After forming the polishing layer 101 and the window 102, at least one first groove 104*a* is formed in the polishing layer 101 and at least one second groove 104*b* is formed in the window 102. In an embodiment of the present invention, as shown in FIG. 3, the first groove 104*a* and the second groove 104*b* may be formed by chucking the polishing pad 100 with a chuck apparatus 200, wherein the chuck apparatus 200 has a recession portion 202 corresponding to the window 102 so that the window 102 in the polishing layer 101 is deformed. The chuck apparatus 200 may be a vacuum chuck apparatus, an electrostatic chuck apparatus or other type, for example. Thereafter, the first groove 104*a* is formed in the polishing layer 101 and the second groove 104*b* is formed in the window 102. The method for forming the first groove 104*a* and the second groove 104*b* may be performed by a mechanical process, such as using a mechanical cutting tool 250, or a chemical process, such as chemical etching, or other known processes. As shown in FIG. 3, when the polishing pad 100 is chucked on the chuck apparatus 200, the window 102 is deformed because of the recession portion 202 of the chuck apparatus 200, and the upper surface of the deformed window 102 presents a concave surface. Hence, when performing the cutting process by using the mechanical cutting tool 250, the first groove 104*a* formed in the polishing layer 101 can be deeper than the second groove 104*b* formed in the window 102. Furthermore, since the upper surface of the deformed window 102 presents a concave surface when the polishing pad 100 is chucked on the chuck apparatus 200, the second groove 104*b* formed in the window 102 has a larger depth h2 at the edge area of the window 102 and has a less depth h3 substantially at the central area of the window 102.

Figure 4:
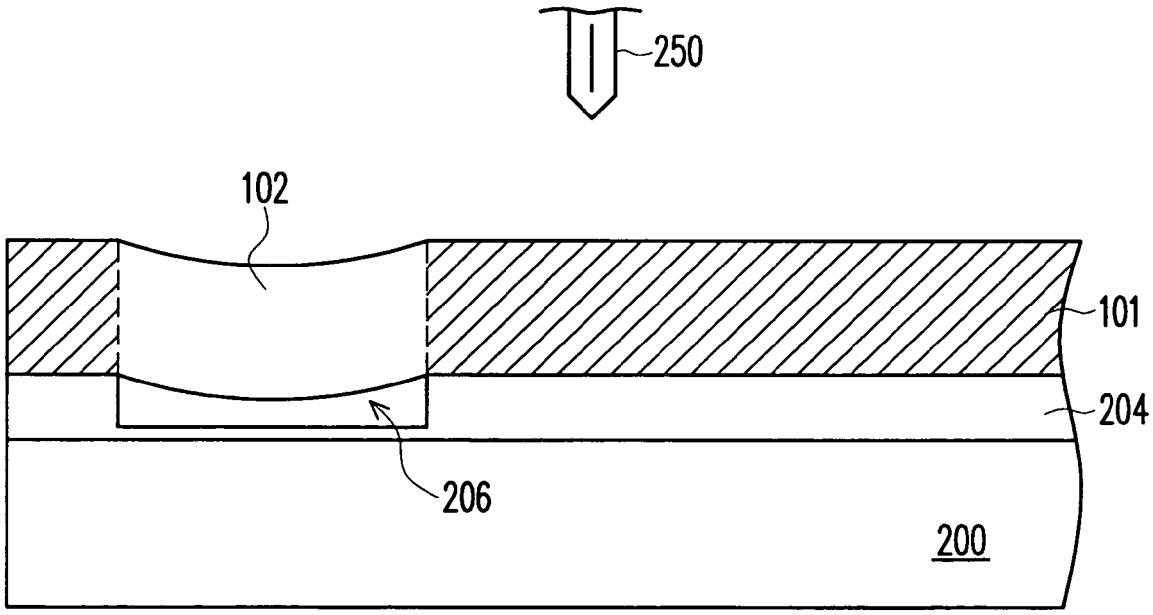
FIG. 4 is a schematic cross-sectional view showing a method of forming first groove and second groove in a polishing pad according to another embodiment of the present invention.

In another embodiment of the present invention, as shown in FIG. 4, the first groove 104*a* and the second groove 104*b* are formed by chucking the polishing pad 100 with a chuck apparatus 200. Further, a support layer 204 is disposed between the chuck apparatus 200 and the polishing pad 100. More particularly, the support layer 204 has a recession portion 206 corresponding to the window 102 so that the window 102 in the polishing layer 101 is deformed. Similarly, the chuck apparatus 200 may be a vacuum chuck apparatus, an electrostatic chuck apparatus or other type apparatus, for example. Thereafter, the first groove 104*a* is formed in the polishing layer 101 and the second groove 104*b* is formed in the window 102. The method for forming the first groove 104*a* and the second groove 104*b* may be performed by a mechanical process, such as using a mechanical cutting tool 250, or a chemical process, such as chemical etching, or other known processes.

Figure 5A:
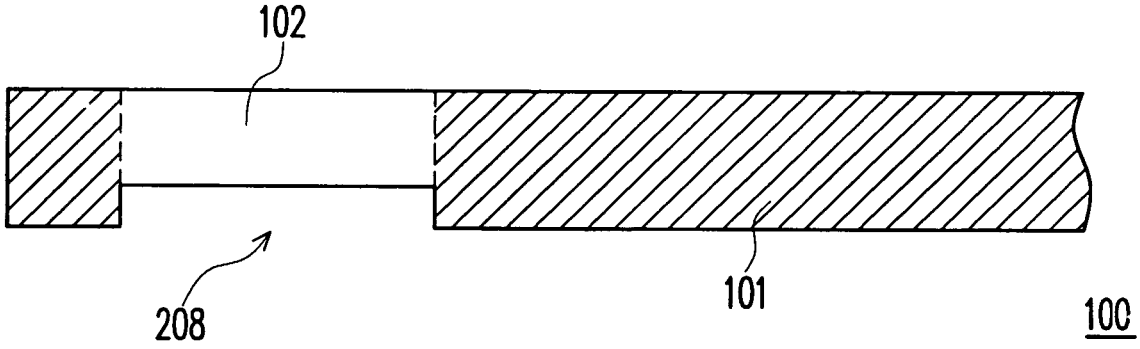
FIG. 5A and FIG. 5B are schematic cross-sectional views showing a method of forming first groove and second groove in a polishing pad according to another embodiment of the present invention.
Figure 5B:
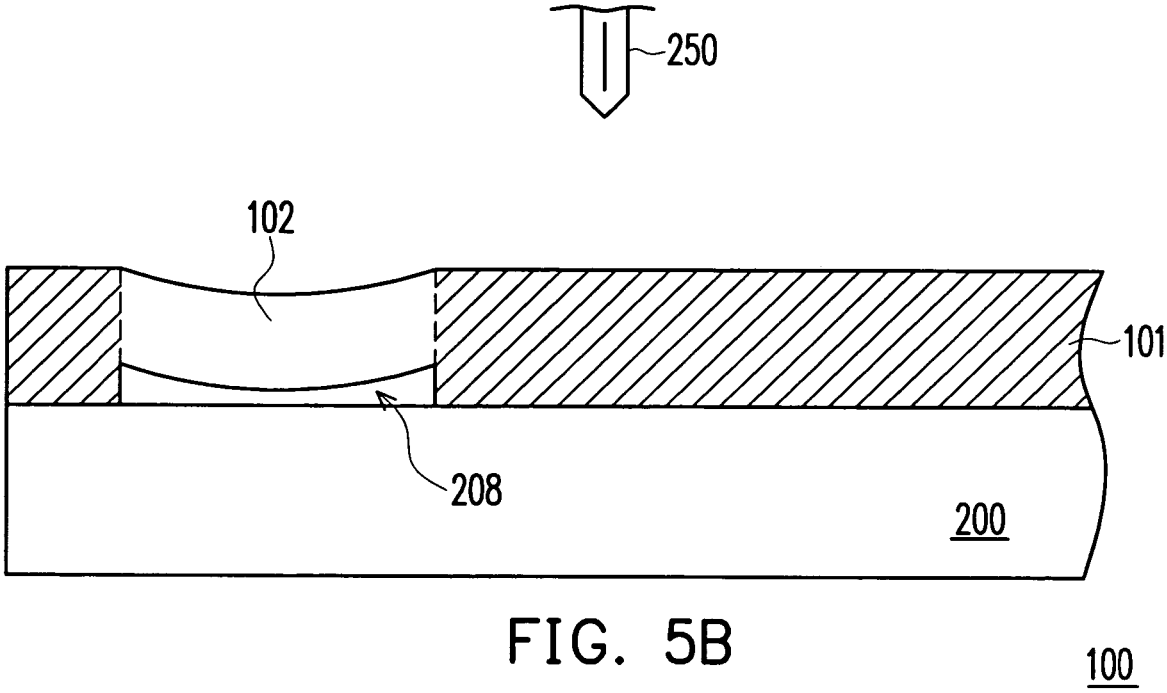
Figure 6A:
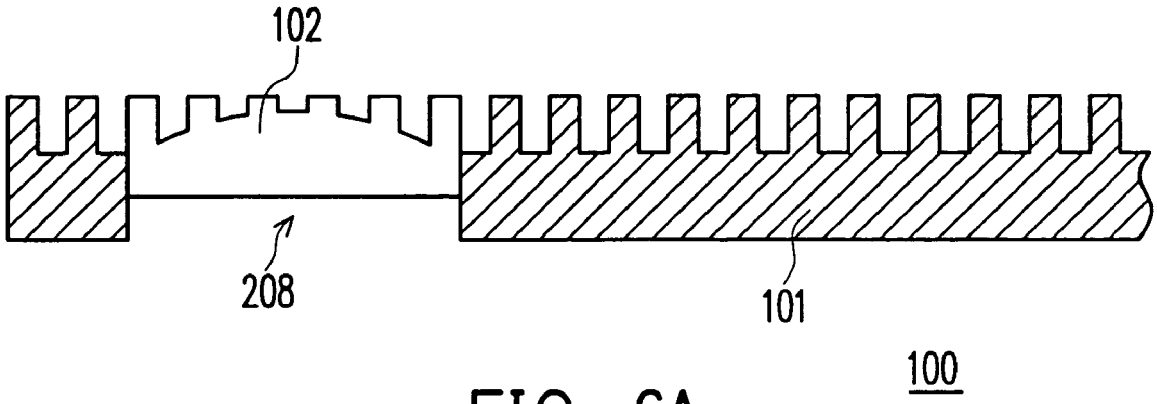
FIG. 6A, FIG. 6B, and FIG. 6C are schematic cross-sectional views showing a polishing pad according to an embodiment of the present invention.

In another embodiment of the present invention, as shown in FIGS. 5A and 5B, the first groove 104*a* and the second groove 104*b* formed by first forming a recession portion 208 in the backside of the window 102, as shown in FIG. 5A. Next, the polishing pad 100 is chucked with a chuck apparatus 200, as shown in FIG. 5B, wherein the window 102 in the polishing layer 101 is deformed because of the backside recession portion 208 of the window 102. Similarly, the chuck apparatus 200 may be a vacuum chuck apparatus, an electrostatic chuck apparatus or other type, for example. Thereafter, the first groove 104*a* is formed in the polishing layer 101 and the second groove 104*b* is formed in the window 102 to obtain a polish pad 100, in which the window 102 has a recession portion 208 in the backside of the window 102, as shown in FIG. 6A. The method for forming the first groove 104*a* and the second groove 104*b* may be performed by a mechanical process, such as using a mechanical cutting tool 250, or a chemical process, such as chemical etching, or other known processes. In an embodiment of the present invention, the recession portion 208 in the backside of the window 102 is formed with a mechanical process, such as mechanical cutting, or a chemical process, such as chemical etching, for example. In another embodiment of the present invention, the recession portion 208 in the backside of the window 102 is formed through a molding process. For example, when forming the polishing layer 101 and the window 102 with a molding process, a sacrificial material is disposed within the mold stacking with the window 102, and then a polymer is injected into the mold to form the polishing layer 101. After releasing the mold, the sacrificial material is removed, and an integral unit comprising a polishing layer 101 and a window 102 with a backside recession portion 208 can be obtained. In the other embodiment of the present invention, the recession portion 208 in the backside of the window 102 may be formed through a molding process with a mold having a protrusion corresponding to the window position, and then a polymer is injected into the mold to form the polishing layer 101. After releasing the mold, an integral unit comprising a polishing layer 101 and a window 102 with a backside recession portion 208 can be obtained.

Figure 6B:
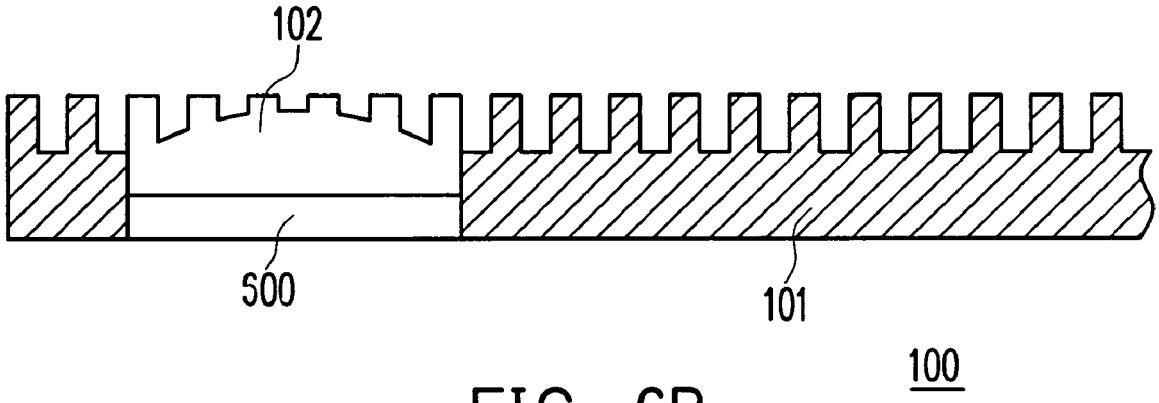
Figure 6C:
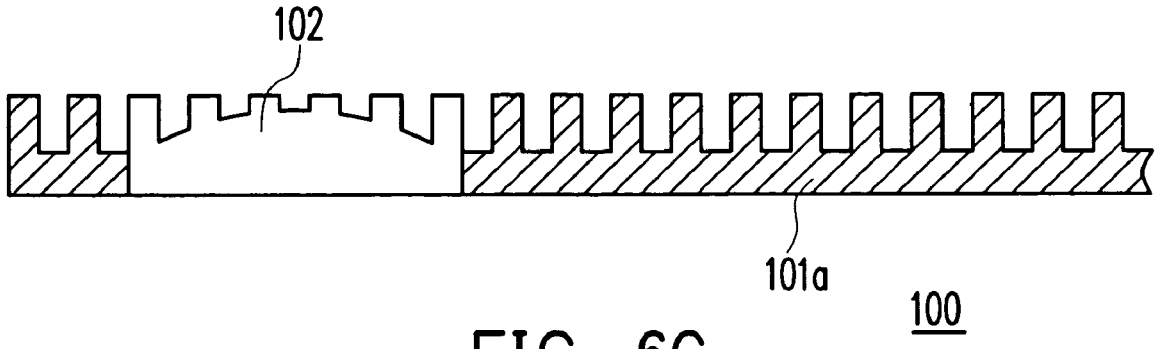

It is should be noted that in the embodiment described with reference to FIG. 5A, FIG. 5B, and FIG. 6A, after forming the first grooves 104*a* and the second grooves 104*b*, a step of leveling may be performed by forming a transparent material 600 at the recession portion 208 of the window 102 on the backside of the polishing pad to obtain a planar backside surface as shown in FIG. 6B. Alternatively, as shown in FIG. 6C, the step of leveling on the backside of the polishing pad to obtain a planar backside surface may be performed by removing the backside of the polishing layer 101 with a mechanical process, such as mechanical cutting.

According to the foregoing, by deforming the window, at least one second groove having different depths can be formed in the window. Particularly, the second groove at the edge area of the window has a substantially deeper depth compared to the second groove at the central area of the window. More particularly, the profile of the depth of the second groove is such that the depth gradually reduces from the edge area of the window towards the central area of the window. Therefore, slurry does not be retained within the second groove and the endpoint detection can be precise.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method of forming a polishing pad, comprising:

forming a window in a polishing layer; and forming at least one first groove in the polishing layer and at least one second groove in the window, wherein the first groove is deeper than the second groove, wherein before the step of forming the first groove in the polishing layer and the second groove in the window further comprises:

chucking the polishing pad with a chuck apparatus, wherein the chuck apparatus has a recession portion corresponding to the window so that the window in the polishing layer is deformed.

2. The method of forming a polishing pad according to claim 1, wherein the chuck apparatus comprises a vacuum chuck apparatus or an electrostatic chuck apparatus.

3. A method of forming a polishing pad, comprising:

forming a window in a polishing layer; and forming at least one first groove in the polishing layer and at least one second groove in the window, wherein the first groove is deeper than the second groove, wherein before the step of forming the first groove in the polishing layer and the second groove in the window comprises:

chucking the polishing pad with a chuck apparatus, wherein a support layer is disposed between the chuck apparatus and the polishing pad, and the support layer has a recession portion corresponding to the window so that the window in the polishing layer is deformed.

4. The method of forming a polishing pad according to claim 3, wherein the chuck apparatus comprises a vacuum chuck apparatus or an electrostatic chuck apparatus.

5. A method of forming a polishing pad, comprising:

forming a window in a polishing layer; and forming at least one first groove in the polishing layer and at least one second groove in the window, wherein the first groove is deeper than the second groove, wherein before the step of forming the first groove in the polishing layer and the second groove in the window further comprises:

forming a recession portion in the backside of the window; and chucking the polishing pad with a chuck apparatus, wherein the window in the polishing layer is deformed because of the backside recession portion of the window.

6. The method of forming a polishing pad according to claim 5, wherein the step of forming the recession portion in the backside of the window comprises performing a mechanical process or a chemical process.

7. The method of forming a polishing pad according to claim 5, wherein the polishing layer and the window are formed with a molding process, and the step of forming the recession portion in the backside of the window is by disposing a sacrificial material stacking with the window within a mold when performing the molding process.

8. The method of forming a polishing pad according to claim 5, wherein the polishing layer and the window are formed with a molding process, and the step of forming the recession portion in the backside of the window comprises providing a mold having a protrusion corresponding to the window position.

9. The method of forming a polishing pad according to claim 5, wherein the chuck apparatus comprises a vacuum chuck apparatus or an electrostatic chuck apparatus.

10. The method of forming a polishing pad according to claim 5, further comprising a step of leveling the backside of the polishing pad after forming the first groove and the second groove.

11. The method of forming a polishing pad according to claim 10, wherein the step of leveling the backside of the polishing pad comprises forming a transparent material at the recession portion.

12. The method of forming a polishing pad according to claim 10, wherein the step of leveling the backside of the polishing pad comprises removing the backside of the polishing layer.

* * * * *